United States Patent [19]

Guergen

[11] Patent Number: 4,817,548

[45] Date of Patent: Apr. 4, 1989

[54] MULTIPLE HULL BOAT

[76] Inventor: Karl H. Guergen, DE - 2116, Hanstedt, Fed. Rep. of Germany

[21] Appl. No.: 81,806

[22] Filed: Aug. 5, 1987

[51] Int. Cl.[4] ..... B63H 9/00

[52] U.S. Cl. ..... 114/61; 114/39.1

[58] Field of Search ..... 114/39.1, 102, 103, 114/90, 89, 91, 97, 111, 140, 61

[56] References Cited

U.S. PATENT DOCUMENTS

| | | | |
|---|---|---|---|
| 3,593,684 | 7/1971 | Cogliano | 114/61 |
| 3,796,175 | 3/1974 | Ford, Jr. et al. | 114/61 |
| 4,223,620 | 9/1980 | Dudouyt | 114/61 |
| 4,498,409 | 2/1985 | Edel | 114/61 |
| 4,562,784 | 1/1986 | Lineback | 114/61 |

FOREIGN PATENT DOCUMENTS

| | | |
|---|---|---|
| 2642868 | 3/1978 | Fed. Rep. of Germany . |

*Primary Examiner*—Joseph F. Peters, Jr.
*Assistant Examiner*—Edwin L. Swinehart
*Attorney, Agent, or Firm*—Sixbey, Friedman, Leedom & Ferguson

[57] ABSTRACT

The invention relates to a multiple hull boat, especially a catamaran or trimaran. Extended hulls with various cross-sectional dimensions are provided as lifting device. The thickness of the hulls continuously increases abaft in the upper third part of the hull close to the deck up to the highest and widest hull section and continuously decreases towards the stern. The front hull section is provided as a knife-shaped bow. The deckside is laterally more curved. Hulls are interconnected by means of traverse guide arms. A deck is arranged between hulls. The hull is provided with a keel of almost uniform thickness, extending form the bow towards the stern carrying a center fin. The tubular front and rear traverse guide arms are inserted into bushings, laminated in the hulls. Holding devices are arranged at the opposite hull sides below the deck sides to fasten the deck.

6 Claims, 7 Drawing Sheets

MULTIPLE HULL BOAT

Figure 1:
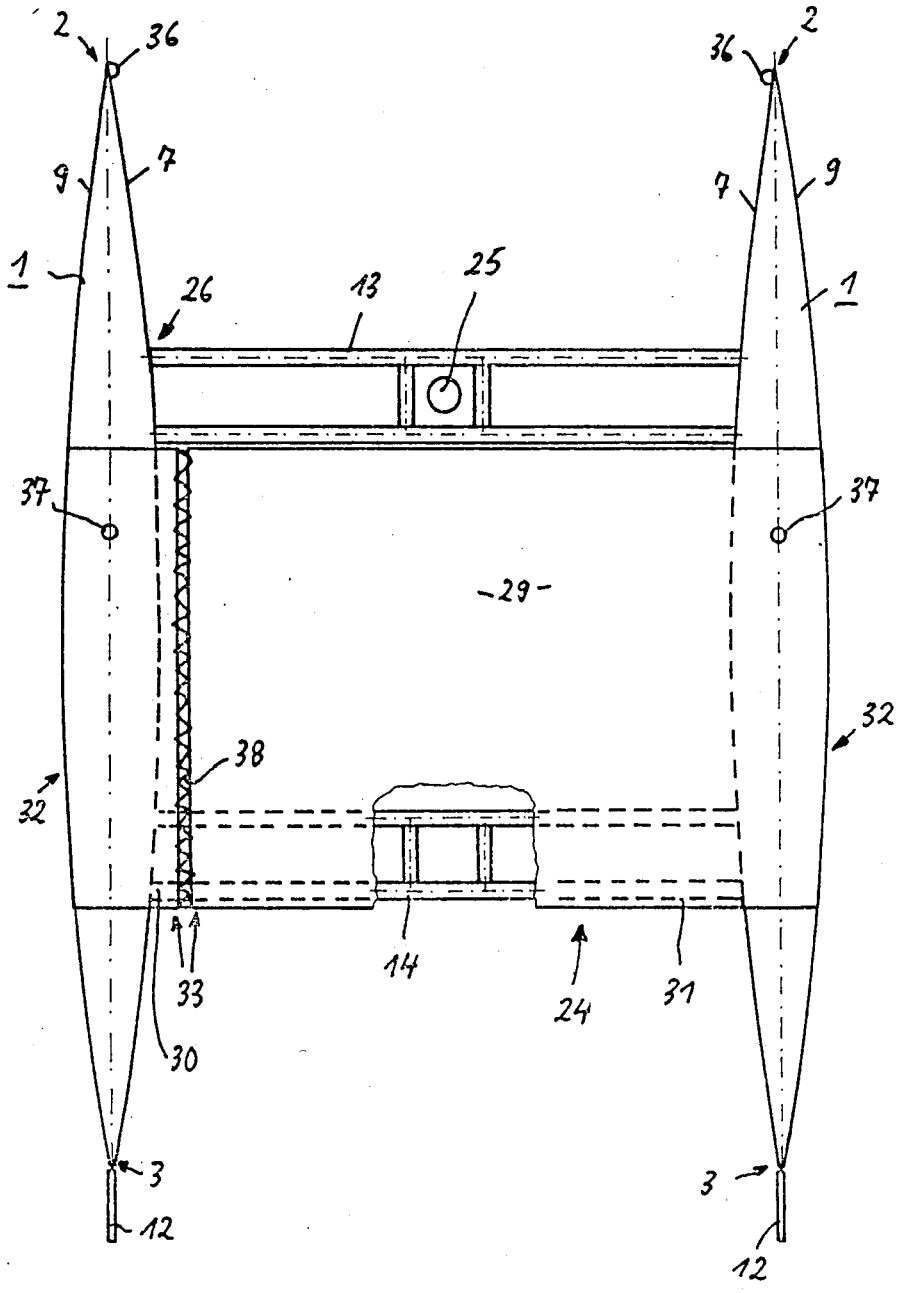

The invention relates to a multiple hull boat, especially a catamaran or trimaran, which provides a lifting device comprising extended hulls with different cross-sectional dimensions increasing continuously backwards to the highest and widest hull section and decreasing continuously towards the stern, whereby the front end of the hull comprises a knife-shaped bow, and the deck is more laterally curved, and the hulls are interconnected by means of traverse guide arms, and a deck is arranged between the hulls.

Current multiple hull boats present the disadvantage of low buoyancy at front hull sections. If used as a sailing boat, it cannot be excluded that especially at high wind forces the hull immerges and undercuts the water. This is a great safety risk for sailing boats. A further disadvantage of especially smaller multiple hull boats is the screw connection between traverse guide arms and the hulls. Assembling and disassembling of such multiple hull boats is therefore complicated.

The object of the invention is to provide a multiple hull boat of mentioned above art for easy and quick assembling and with increased stability, optimal safety when used as a sailing boat, high speed, and with no chance of overturning when the hull is immerged.

According to the invention the problem is solved in that a keel of almost uniform thickness is provided at the bottom side of each hull running from the bow towards the stern and carrying a center fin at the middle hull section, that the deck side of each hull is horizontally arranged in the middle hull section convex sloping towards the water line in both directions to the bow and to the stern, that hull sides are provided with differential curvatures from the bow towards the stern, that the vertical cross section reveals an extremely convex deck side extending to the upper horizontal third part which is adjacent to a middle horizontal hull section with only a slight convex curvature compared to deck side with different curvatures of individual cross sections from the bow toward the stern and passing into an extremely convex surface section in the lower horizontal third part of the hull extending towards the keel, whereby the most voluminous hull section is located in the middle third part of the hull reducing abaft towards a connection line between hull and keel, that bushings are inserted into one hull side in the upper third part of the hull used as connectors for traverse guide arms and that holding devices are arranged at the other hull side to connect the deck.

According to the invention an extremely high initial stability is achieved by means of the hull shape, which can be maintained in contrast to conventional hulls of multiple hull boats even at high speed. The hull shape of this sailing boat always ensures a due proportion between sail pressure and lateral surface, resulting in optimum course stability. The specially constructed highest and widest hull section further gives safety to the sailing boat by preventing the hull from immerging.

According to the special construction of the hull, top edge the lee hull side can immerge without decreasing speed. After all the new hull shows improved characteristic features, does not immerge or undercut the water, and shows high buoyancy at the hull section with the greatest cross-section. High speed is achieved with good stability and safety even by untrained sailors. A further feature is the height of the center fin resulting in a water flow to the rudder without vorticity. This leads to the high initial stability of the hull and ensures immediately a fast gliding of the hull without sucking.

A quick assembling and dissembling of the multiple hull boat is further achieved by means of connectors between traverse guide arms and hulls. Traverse guide arms and hulls are interconnected without being twisted by means of holders when the deck is installed. This stability of shape is increased by bracing a mast with the hulls.

Figure 2:
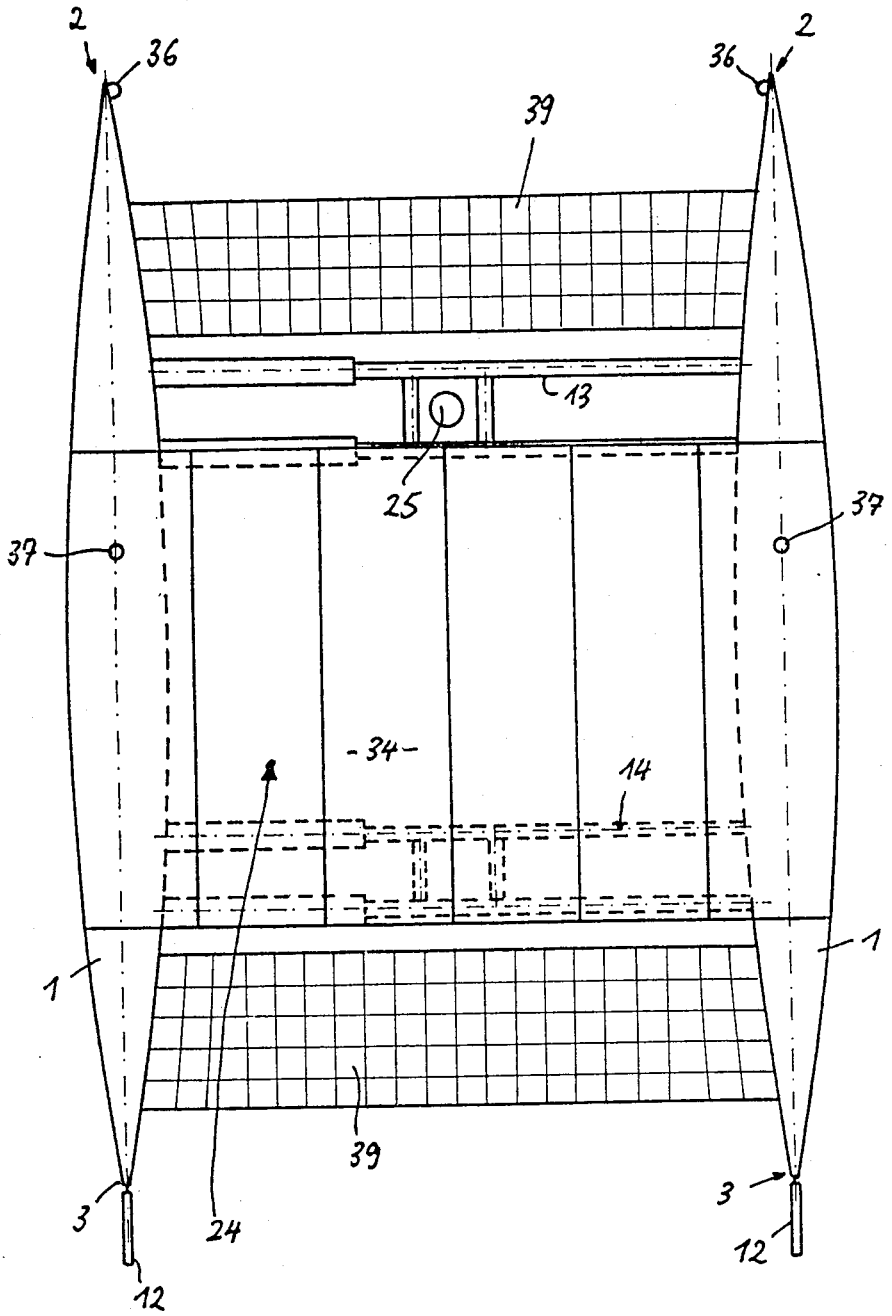
Figure 3:
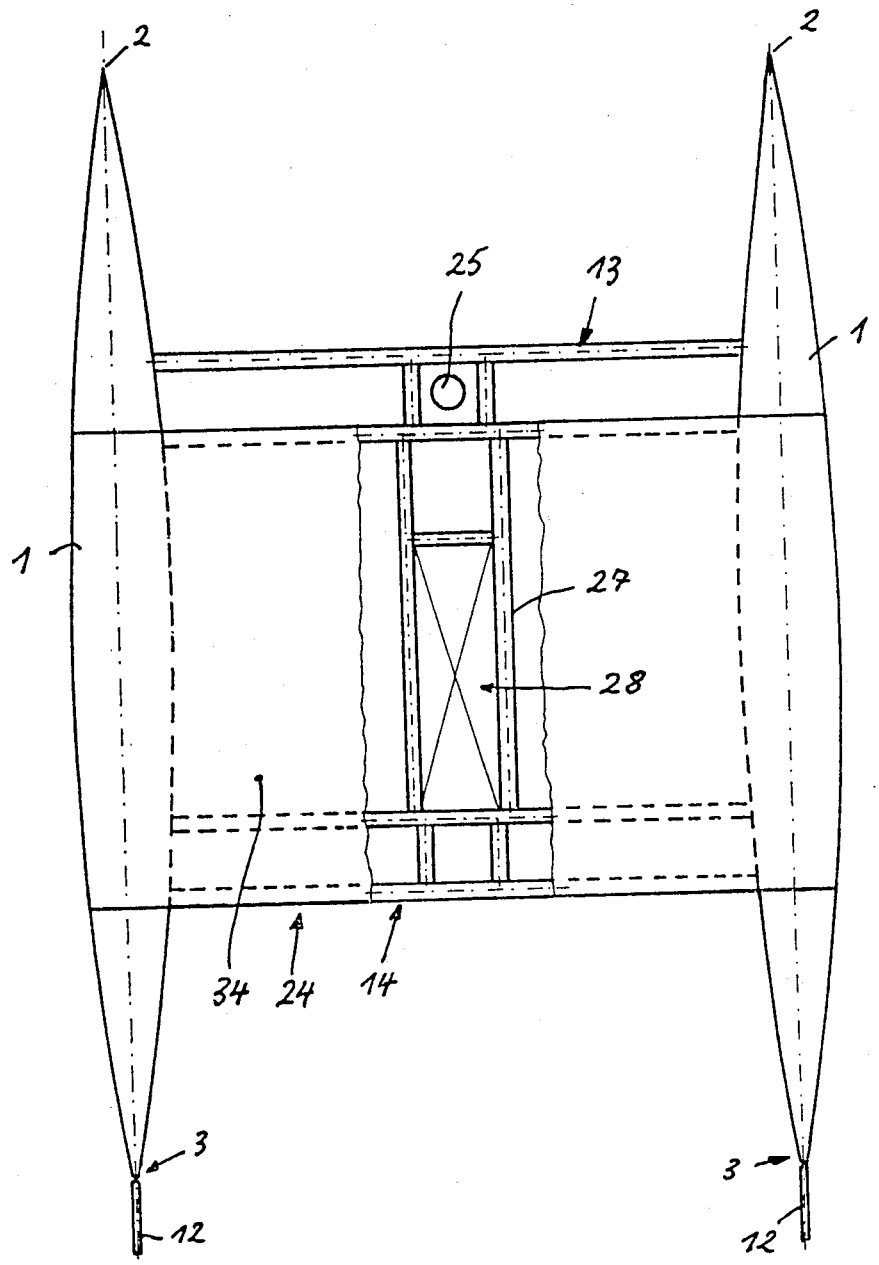
Figure 4:
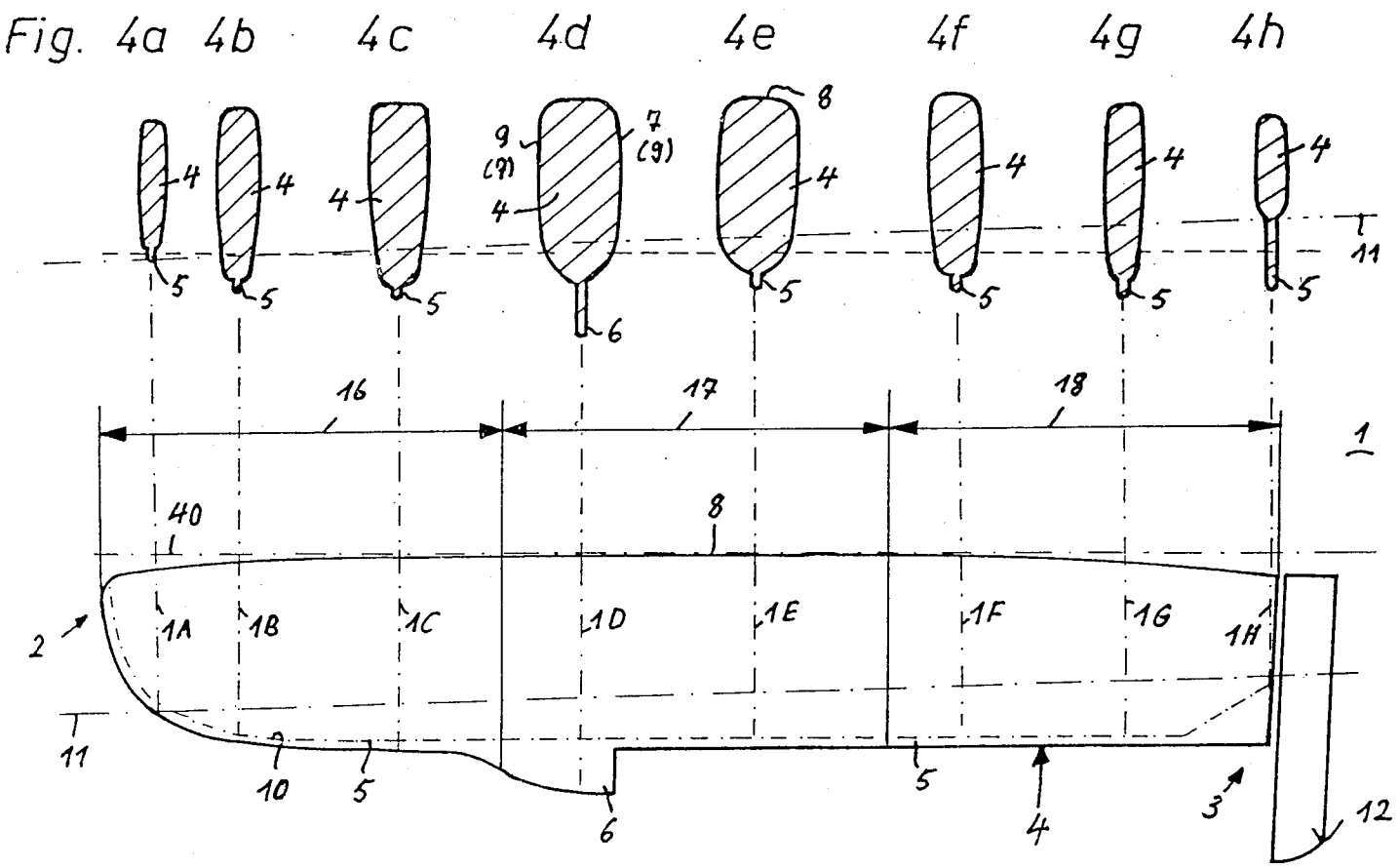
Figures 5, 6:
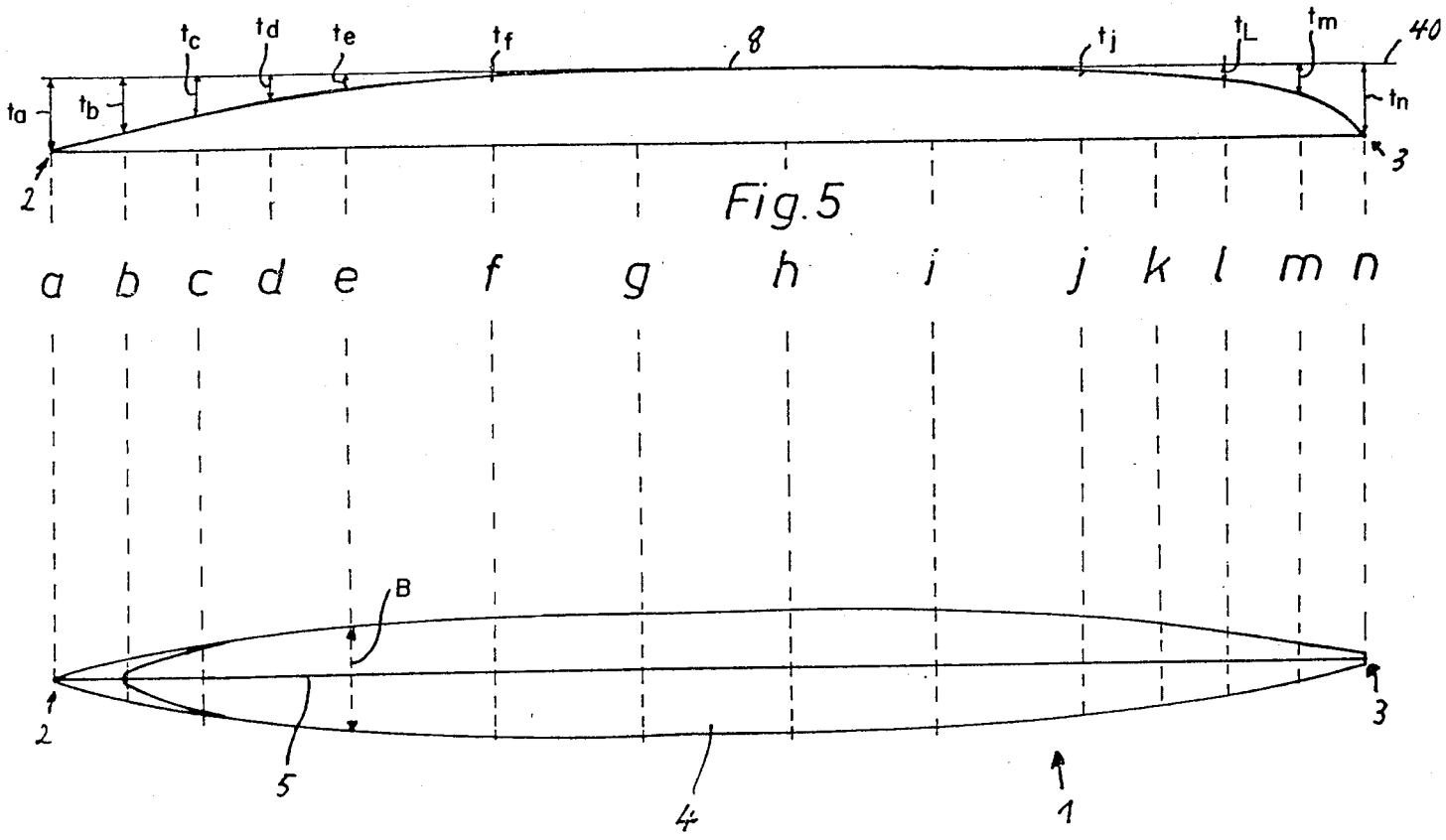
Figure 7:
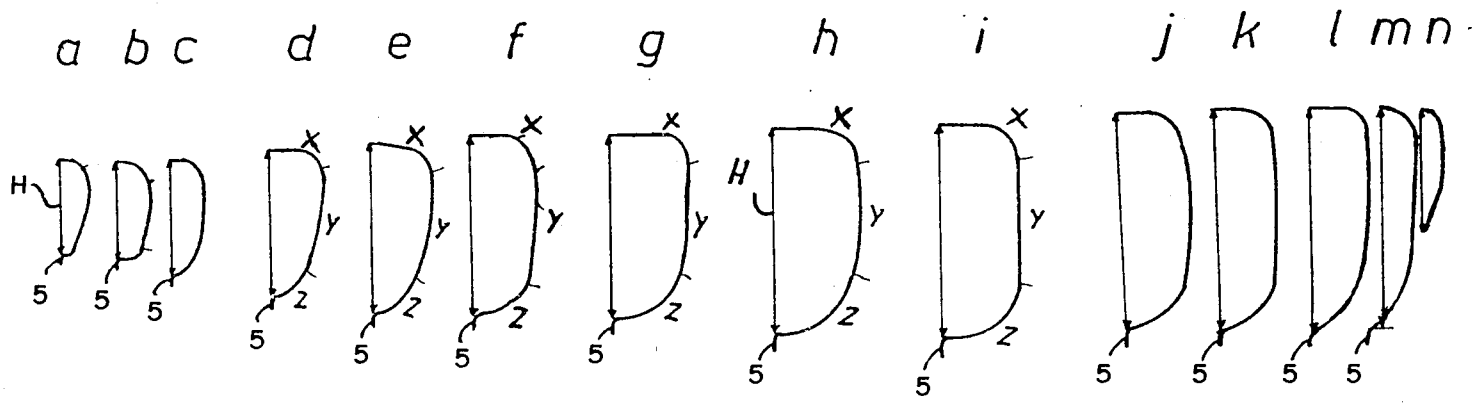
Figure 8:
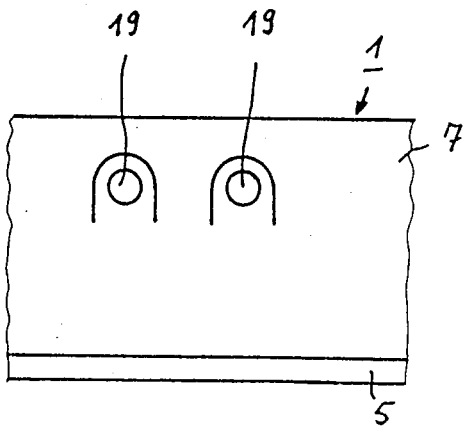
Figure 9:
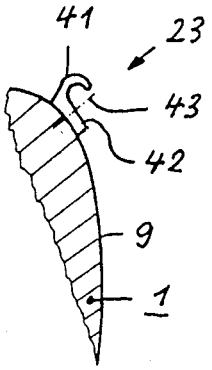

Further features of the invention will be described in the following by way of examples and with reference to the accompanying drawings, in which:

FIGS. 1–3 are three different multiple hull boats in a diagrammatical top view, FIGS. 4 and **4*a*–14*h* show a hull of multiple hull boats according to FIGS. 1 to 3 in a diagrammatical side view as well as in different cross-sectional views, FIG. 5 the deck of a hull according to the invention, FIG. 6 the hull according to FIG. 5 in a bottom view, FIGS. 7*a*–7*n* show side views of the hull according to FIG. 5, FIG. 8 the arrangement of bushings in one hull as a connection for a traverse guide arm in a detail view, FIG. 9 the arrangement of a hooklike holder to attach the deck shown in a detail view, The multiple hull boat shown as a catamaran 20 in FIG. 1 consists of two hulls 1 that are interconnected by means of a front traverse guide arm 13 and a rear traverse guide arm 14. A holding bush 25 is provided in the front traverse guide arm 13 to fix the mast. The end sections 26 of traverse guide arms 13, 14 facing the inner hull sides 7 are inserted into bushings 19 laminated into hulls 1. These bushings 19 are diagrammatically shown in FIG. 8. A rudder 12 is hinged at the stern 3 of each hull 1. One eyelet 36 is provided at each bow tip 2 and another eyelet 37 is provided on the hull 1** used for bracing a mast, not shown in detail herein.

The deck 24 is provided as a two-piece awning 29. The outer edge sections 32 of awning pieces 30, 31 are attached to the holding device 23 joining sections 33 of awning pieces 30, 31 are braced by means of a line 38. The hulls are pressed to the end sections 26 of traverse guide arms 13, 14 that sufficient shape stability of the catamaran is achieved even without special screw connections. At bigger catamarans end sections 26 of traverse guide arms 13, 14 are barred and additionally connected to the hull by means of bushing connections. In this case recesses are provided in hulls 1, lockable by means of flaps, in which screw connections are arranged for attachment of traverse guide arms to the hull 1.

FIG. 2 shows another multiple hull boat provided as a catamaran 21. For this catamaran infinitely variable telescoping traverse guide arms 13, 14 are provided resulting in a catamaran 21 of different width. According to this construction it is possible to adapt sail characteristics of the catamaran to different wind forces and to push hulls 1 together to reduce the required space, if the boat is berthed. For operation of catamaran 21 the traverse guide arms can be extended to achieve a greater distance between both hulls 1, resulting in a better stability of catamaran 21.

The deck 24 is provided as a folded plate 35 removably connected to traverse guide arms 13, 14. In bigger catamarans 21 store-rooms, day-rooms, and a room for an engine drive can be provided.

A catamaran 22 is diagrammatically shown in FIG. 3, which can also be used as a motor boat. The deck is constructed as a plate 34 with a recess centrally arranged. This recess corresponds with a longitudinal traverse guide arm 27 arranged between the front and rear traverse guide arm 13, 14. A holding device 28 is arranged at longitudinal traverse guide arm 27 to fix the motor. Together with the holding device 28 the motor, not shown in detail, can be moved parallelly to longitudinal axis of the catamaran 22 so that an optimum trimming is achieved.

According to the invention the hull 1 of a multiple hull boat is provided with an extended shape as shown in FIG. 4, extending abaft to the stern 3 from the bow 2. The hull 1 consists of a lifting device constructed as an extending hull 4 with varying cross-sectional dimensions, as shown by individual cross-sections with reference to FIGS. 4*a* to 4*h*. A keel 5 is provided at the bottom side of hull 4, carrying a center fin 6. The body 4 of hull 1 extends from knife-shaped bow 2 abaft, forming a bulgy hull section 1D located in the middle third part 17 at the highest and widest hull section, and comprises reduced cross-sectional-diameters towards a vertically constricted hull section 1H in the rear third part 18 of the hull which forms the stern 3.

With reference to accompanying drawings the construction of the hull 1 as well as of special sections thereof are shown in FIGS. 4 to 7*n*.

The profile of hull 4 is not only achieved by special cross-sections according to FIGS. 4*a* to 4*h*, but also by the profile of the upper deck side 8, both hull sides 7, 9 and the lower boundary line 10 of hull 4, providing the connection between hull 4 and keel 5. The front and rear structure of hull 1 is essentially the same.

The deck side 8 of hull 1 slopes starting form the middle section of the hull, the middle third part 17, towards bow 2 and stern 3 and forms a convex side. This ensures a good water flow running from the bow 2 to the stern 3 and prevents the bow from immerging. Both hull sides 7, 9, running from deck side 8 down to the edge line 10 of hull 4, are provided as plane or slightly convex sides in the front or rear part 16, 18 following the special cross-sections shown in FIGS. 4*a* to 4*h* according to FIG. 4.

Lower edge 10 of hull 4 is parallel and horizontally arranged to deck side 8 in the middle hull section 17, but not within the range of bow 2 and stern 3.

Various cross-sections provided by means of special construction of deck side 8, both hull sides 7, 9, and the lower edge 10 are shown in FIGS. 4*a* to 4*h*. Hull 4 is so constructed that the horizontal cross-sectional area continuously increases near the deck as well as in the middle of hull 4 up to the highest and widest hull section 1D and then continuously decreases towards the stern 3. The cross section of hull 4 is preferably reduced to less than one third of the widest cross section between highest and widest hull section ID and stern 3. In contrast to this, the cross-sectional area of hull 4 from cross-section 1A to 1D is more increased than the cross-sectional area of hull 4 is decreased from cross sections 1D to 1H.

Cross-sectional proportions are nearly the same along the water line 11, shown as a broken line in FIG. 4, in the deck region and at half height of the hull, but with different cross-sectional dimensions. According to the cross-sections of hull 1 the greatest buoyancy is achieved within the range of sail gravity center. The most voluminous hull section is provided in the middle third part 17, decreasing abaft towards edge 10 of hull 4. A connection to keel 5 is provided at the lower edge 10 with a width of hull 4 similar to that of keel 5 at the connection between hull 4 an keel 5 in the rear third hull part 18. The knife-shaped bow 2 at the front end of hull 4 slopes plainly and passes into the keel 5. Keel 5 extends from bow 2 along center fin 6 down to the stern 3 at constant thickness. A rudder 12 is hinged at stern 3 attacked by the water as usual. The rim of stern 3 is 5° inclined to reduce rudder force.

Center fin 6 is arranged at highest and widest hull section ID below sail gravity center so that the boat is neither carrying lee helm nor weathery.

The geometry of hull 1 is shown for one hull 1 with reference to FIGS. 5 to 7*n*. The length of hull 1 is 450 cm. Hull 1 is provided with a semi-monocoque structure of two halfs 48 bonded together. The dimensions of different hull sections shown in the following table illustrate the shape.

| Cross-section | Height H (cm) | Width B (cm) | x (cm) | y (cm) | z (cm) | $t_i$ (cm) | Length from bow |
|---|---|---|---|---|---|---|---|
| a | 30 | 6 | | | | 10 | 0 |
| b | 40 | 9 | 6,8 | 30 | 4 | 8 | 25 |
| c | 47 | 13 | 13 | 40 | 7 | 6,8 | 50 |
| d | 53 | | 7,5 | 35 | 15 | 4,5 | 75 |
| e | 57 | 20 | 19 | 40 | 17 | 3,2 | 100 |
| f | 64 | 26 | 23 | 40 | 24 | 0,8 | 150 |
| | | | | | | 0,4 | 175 |
| g | 66 | 30 | 20 | 40 | 26 | | 200 |
| h | 65 | 30,6 | | | | | 250 |
| i | 64 | 24,5 | 30 | 40 | 24 | | 300 |
| | | | | | | 0,4 | 325 |
| j | 57 | 11 | 17 | 40 | 17 | 1,5 | 350 |
| k | 52 | | 15 | 30 | 22 | | 375 |
| l | 47 | | 14,5 | | | 5 | 400 |
| m | 42 | | 11,5 | 30 | 12 | 7 | 425 |
| n | 30 | 5,5 | 3 | 28 | 3 | 9 | 450 |

The constructions of the hull shown by the accompanying drawings in detail and described herein before allows any given position of the mast in the front, middle, or rear hull section 16, 17, 18 as well as various sail constructions without using a center-board. The described hull 1 is extremely safe from overturning because of low position of gravity center, and undercutting is also prevented, and a steady water flow is achieved along the hull.

The holding device 23 for attachment of the deck 24 is diagrammatically shown in FIG. 9. It consists of a hook 41, being attached to a plate 42. The plate 42 is adapted to the shape of outer hull side 9 in the upper third part of hull 1. The holding device 23 is connected to hull 1 by means of screw mounting.

It is also possible, to provide a bridge at the front traverse guide arm 13, used as a holding device for a mast or provided with a lockable store-room. As shown in FIG. 2, an additional net can be provided before or behind the deck 24.

I claim:

1. Multiple hull boat comprising at least two hulls with holding devices and a deck removably attached to the hulls by said holding devices; wherein each hull has a knife-shaped bow that merges rearwardly into a keel of substantially uniform thickness extending from the bow to a stern of the hull, said keel having a center fin arranged at a highest and widest section of the hull below a sail center of gravity; wherein the cross-sectional dimensions of each hull in transversely extending vertical planes vary in an asymmetric manner with the cross-sectional area of the hull decreasing continuously to the bow and to the stern from a longitudinally middle portion of the hull containing said highest and widest section, the cross-sectional area at the stern being less than one-third of the cross-sectional area at the highest and widest section; wherein a top side of each hull is transversely convex and is arranged to extend longitudinally in a horizontal plane in said middle portion of the hull and to convexly curve downwardly below said horizontal plane from said middle portion rearwardly toward the stern and forwardly toward the bow; wherein a lower boundary line of the hull, at a junction between the bottom of the hull and the keel, extends horizontally between the bow and the stern and is parallel to the topside of the hull in said middle portion; and wherein lateral sides of the hull are convexly curved in longitudinal directions from said middle portion forwardly toward the bow and rearwardly toward the stern, and have a slightly convex curvature between the topside and bottom of the hull.

2. Multiple hull boat according to claim 1, wherein the width of the hull decreases from said highest and widest section abaft and to the bow.

3. Multiple hull boat according to claim 1, wherein the width of the hull along the waterline decreases from said highest and widest section abaft.

4. Multiple hull boat according to claim 1, wherein said hull is widest in the domain of the waterline.

5. Multiple hull boat according to claim 1, wherein said holding devices are hook-like holders and said deck is one of awning and plate type arrangements.

6. Multiple hull boat according to claim 1, wherein the cross-sectional area is more decreased from said highest and widest section in a part of the hull located forwardly thereof than in part of the hull located rearwardly thereof.

* * * * *